United States Patent [19]

Hatch

[11] Patent Number: 4,644,982

[45] Date of Patent: Feb. 24, 1987

[54] REFRIGERANT MATERIAL TRANSFER ADAPTER

[76] Inventor: Jimmie K. Hatch, 7819 Lowery St., Fort Worth, Tex. 76112

[21] Appl. No.: 778,879

[22] Filed: Sep. 23, 1985

[51] Int. Cl.[4] ..... B65B 3/04

[52] U.S. Cl. ..... 141/383; 141/392

[58] Field of Search ..... 141/348-362, 141/382-389, 392

[56] References Cited

U.S. PATENT DOCUMENTS 2,229,213 1/1941 Kubiliunas ..... 141/389

*Primary Examiner*—Houston S. Bell, Jr.

*Attorney, Agent, or Firm*—Warren H. Kintzinger

[57] ABSTRACT

A refrigerant material transfer adapter in the form of an instrument of semi rigid yet flexible plastic having a side tube projection that fits on an aerosol can valve stem of the type that opens the can valve for release of contents when the valve stem is sidewise angle deflected. The adapter has an outlet end with an opening shaped to fit on and over the low pressure suction side valve fitting of a refrigeration system. A center projection within the outlet end opening engages the valve stem of the refrigeration system suction side valve fitting so that when the adapter is pushed toward the refrigeration valve fitting the refrigeration system valve is opened. This is accomplished generally using both hands or with the thumb of the hand holding the aerosol can pressing against the back end of the adapter. With the adapter so positioned and pushed the hand holding the aerosol can moves the can so the valve stem inserted in the adapter side tube is deflected to a sidewise angle relative to the can sufficiently to open the can valve so that refrigeration gases and/or fluids are aerosol propelled from the can to the refrigeration system. This contributes a factor of safety in that the can valve is opened only after the refrigeration system valve is opened.

16 Claims, 5 Drawing Figures

REFRIGERANT MATERIAL TRANSFER ADAPTER

Figure 1:
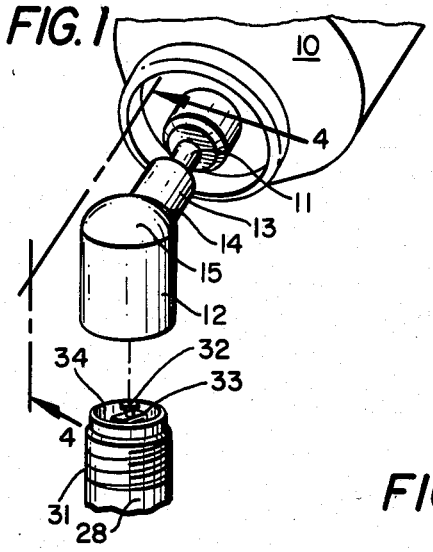

This invention relates in general to gas and fluid transfer connectors, and more particularly, to a refrigerant material transfer adapter useful in charging refrigerant systems.

Heretofore, special and expensive tools and equipment have been needed to inject automotive air conditioner gas fluids and chemicals from both pressurized aerosol containers and non-aerosol cans. Use of such equipment can be awkward and demanding, requiring more skill, experience and knowledge than most people have on the subject. An improvement in charging freon, and introducing aerosol driven chemicals such as lubricants, leak detector and sealer material, and system contaminant treating materials from aerosol cans to refrigerant systems is most welcome. The improvement is in the form of an adapter with a side tube projection that fits on a freon can hollow valve system or the standard valve stem of aerosol driven refrigerant material supply cans having valve stems deflectable to a sidewise angle to open the can valve, and that has an outlet end opening shaped to fit on and over the low pressure suction side valve fitting of a refrigeration system.

It is therefore a principal object of this invention to provide for the direct transfer of refrigerant, fluids and chemicals from convenient supply cans to refrigeration systems such as automotive air conditioners.

Another object is to provide an adapter facilitating such direct transfer of refrigerant system materials by pushing the adapter to open the refrigeration system suction side valve fitting and then moving the can to deflect the can valve stem to a sidewise angle opening the can valve.

A further object is to provide such refrigerant material transfer without significant material leakage.

Still another object is to eliminate any need for expensive, complicated and hard to use refrigerant material transfer equipment in charging a refrigeration system such as an automotive air conditioner.

Another object with such a refrigerant material transfer adapter is to make it simple, reliable, quick and easy for the average motorist to charge his car air conditioner with refrigerant material ingredients.

Features of the invention useful in accomplishing the above objects include, in a refrigerant material transfer adapter, an adapter in the form of an instrument of semi-rigid yet flexible plastic having a side tube projection that fits on an aerosol can valve stem of the type that opens the can valve for release of contents when the valve stem is sidewise angle deflected. The adapter has an outlet end with an opening shaped to fit on and over the low pressure suction side valve fitting of a refrigeration system. A center projection within the outlet end opening engages the valve stem of the refrigeration system suction side valve fitting so that when the adapter is pushed toward the refrigeration valve fitting the refrigeration system valve is opened. This is accomplished generally using both hands or with the thumb of the hand holding the aerosol can pressing against the back end of the adapter. With the adapter so positioned and pushed the hand holding the aerosol can moves the can so the valve stem inserted in the adapter side tube is deflected to a sidewise angle relative to the can sufficiently to open the can valve so that refrigeration gases and/or fluids are aerosol propelled from the can to the refrigeration system. This results in refrigeration material gases and/or fluids being aerosol propelled from the can to the refrigeration system through internal passage openings within the adapter. The adapter is so sized and resiliently deflectable while relatively stiff that the side tube projection so seals the aerosol can hollow valve stem and the adapter outlet end opening so fits the refrigeration system valve fitting that refrigerant materials are transferred with very little, if any, leakage.

A specific embodiment representing what is presently regarded as the best mode of carrying out the invention is illustrated in the accompanying drawing.

Figure 2:
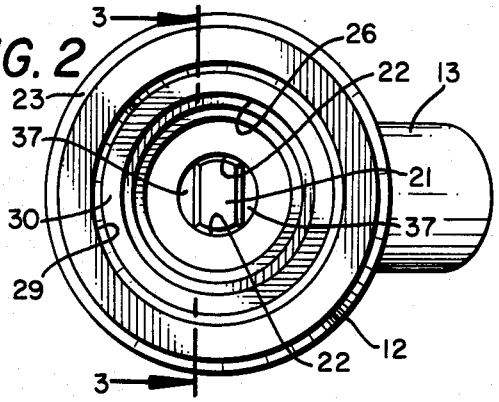
Figure 4:
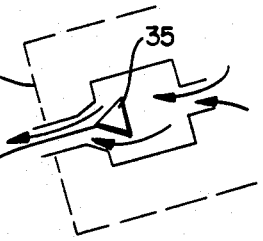
Figure 4:
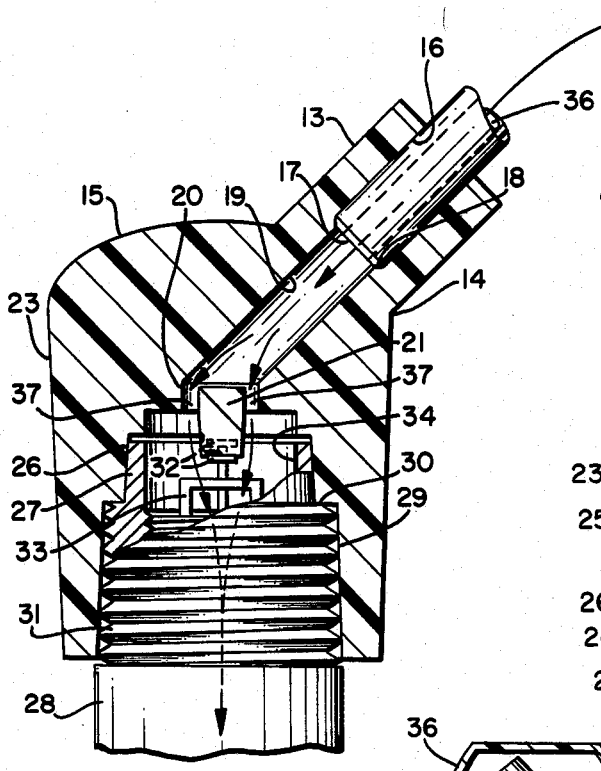
Figure 3:
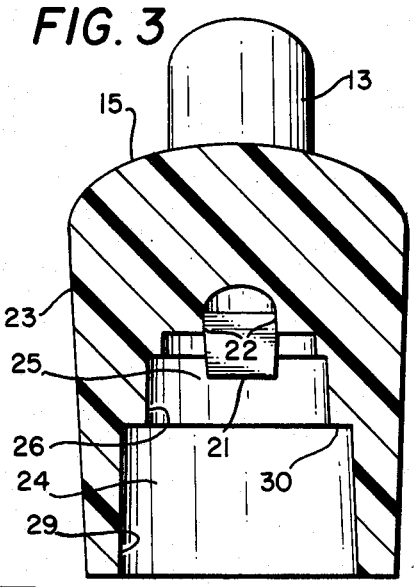
Figure 5:
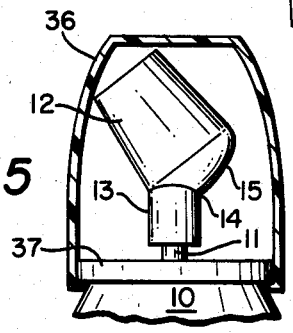

In the drawing:

FIG. 1 represents a perspective view of an aerosol can with a refrigerant material transfer adapter having a side tube projection mounted on the can valve stem in position to be placed on and over the low pressure suction side valve fitting of a refrigeration system such as with a car air conditioner;

FIG. 2, a view directed toward the open outlet end of the adapter of FIG. 1;

FIG. 3, a cutaway and sectioned view taken along line 3—3 on the adapter of FIG. 2;

FIG. 4, partially cut away and sectioned view taken generally along line 4—4 of FIG. 1 with the adapter fully in place pressed on the pressure suction side valve fitting of a refrigeration system and with the valve system of the can indicated schematically; and, FIG. 5, a partial cut away and sectioned view of a protective cover in place on a can top and enclosing the adapter mounted on the can valve stem.

Referring to the drawing:

The pressurized can 10 of FIG. 1, that may be an aerosol can or refrigerant material can having a valve stem 11 of the type that opens the can valve for release of contents when the valve stem is sidewise angle deflected, is shown to have a refrigerant material transfer adapter 12 with a side tube projection 13 mounted on the valve stem 11. The adapter 12 is in the form of an instrument of semi rigid yet flexible plastic having a side tube projection 13 that fits on a pressurized can 10 valve stem 11. Referring also to FIGS. 2–4 the adapter 12 side tube projection 13 extends outwardly and toward the rear from the rim 14 of the adapter back 15 at an angle of approximately forty five degrees from the plane normal to the longitudinal axis of the adapter and from the axis itself. The side tube projection 13 is formed with a tube opening 16 that is a snug tight fit on valve stem 11 with the end 17 thereof abuting tube shoulder 18. Opening 19 extends from tube opening 16 to adapter back opening 20 that encloses the rear of center projection 21 that spans the opening 20 and has molded support connection 22 at the opposite ends thereof to the rear body 23 at otherwise some wall area of opening 20 within the adapter 12. The output end of the adapter 12 has an output end opening 24 into the bottom portion 25 of which the center projection 21 extends as a generally rectangular center projection. The bottom portion 25 of opening 24 has a slightly tapered portion 26 like a truncated cone that receives the nose end 27 of an air conditioning system suction side valve fitting 28. Output end opening 24 also has a larger slightly tapered opening wall portion 29 extending outwardly from opening shoulder 30 like a truncated cone that receives the threaded portion 31 of the air conditioning system suction side valve fitting 28 with the fitting valve cap removed that should otherwise be in place on the fitting 28 to prevent valve leakage. The center projection 21 is so positioned and short enough to effectively contact and push the valve stem 32 of the valve 33 (that may be a Schrader valve) into the interior opening 34 of the fitting 28 to open the valve 33.

With adapter 12 mounted on valve stem 11 and the adapter 12 pushed onto the refrigeration valve fitting 28 and threaded portion 31 thereof received and seated in adapter output end opening 24 the can 10 may be turned by hand displacing the valve stem 11 to an angle thereby opening the can valve 35 for content release. Then refrigerant material gas, liquid and/or chemicals being transferred passes from valve stem opening 36 through adapter 12 openings 19 and 20 and then through openings 37 on opposite sides of rectangular center projection 21 to outlet end opening 24. The refrigerant material being charged to the air conditioner then passes through the open valve 33 in the fitting 28 to the refrigeration system of the air conditioner. Then as the can 10 is manually moved to straighten valve stem 11 and close valve 35 when the can 10 is depleted or as much refrigerant system charging has been done as desired the adapter 12 may be moved back from fitting 28 and spring loaded valve 33 closes.

It should be noted that the refrigerant material transfer adapter 12 is molded of plastic that while relatively stiff is flexible enough for the truncated cone portion 29 of opening 24 to make an effective sealing engagement with the threaded portion 31 of the air conditioner suction side valve fitting 28 against refrigeration material leakage while system sharging is underway. The adapter 12 is held in place with one hand holding the can 10 and the other hand holding the adapter 12 on the air conditioner suction side valve fitting 28 with enough pressure to depress the valve stem 32 to the open state. Alternately, in some instances the can is held in one hand and the thumb of that hand presses against the back 15 of the adapter 12 to hold the adapter in place on valve fitting 28 with the can 10 moved to an angle relative to valve stem 11 in manipulation by the hand to open valve 35. It should be noted that the space requirements imposed by the adapter 12 with side tube projection angle thereto, when mounted on valve stem 11 permit it to remain so mounted within the protective cover 36 snap mounted over the top rim 37 of the can 10 and over the the can top. These adapters 12 are inexpensive enough that they may be provided mounted on the valve stem 11 of each aerosol can 10 and discarded with each depleted can 10 after use thereof although they may be removed and mounted on the valve stem 11 of other supply cans 10.

Whereas this invention has been described particularly with respect to a single embodiment thereof it should be realized that various changes may be made without deprature from the essential contributions to the art made by the teachings hereof.

I claim:

1. A refrigerant material transfer adapter comprising: an adapter formed of semi-rigid yet resiliently flexible plastic having a side tube projection that fits on the valve stem of a pressurized can having a can valve with a valve stem of the type that opens the can valve for release of contents when the valve stem is sidewise angle deflected; internal shoulder means within said side tube projection limiting the extent of insertion of a can valve stem into said side tube projection; an outlet end opening in said adapter body shaped to fit on and over the low pressure suction side valve fitting of a refrigerant system; projection means within said outlet end opening positioned to engage the valve stem of the refrigeration system suction side valve fitting so that as the adapter is pushed to the seated state on the refrigeration system suction side valve fitting the fitting valve is opened to receive refrigerant material and the pressurized can is moved to open the can valve for movement of refrigerant material from the can through the adapter and the suction side valve fitting into the refrigeration system.

2. The refrigerant material transfer adapter of claim 1, wherein said side tube projection is a projection from the back side of said adapter remote from said outlet end.

3. The refrigerant material transfer adapter of claim 2, wherein opening means is included in said adapter body interconnecting the opening of said side tube projection and said outlet end opening.

4. The refrigerant material transfer adapter of claim 3, wherein said opening means includes an opening within said adapter body in axial alignment with said outlet end opening.

5. The refrigerant material transfer adapter of claim 4, wherein said projection means is generally rectangular in shape mounted in alignment with and spanning the end of said opening within said adapter body and fastened to the wall of said opening; and with said rectangular projection means short enough from end to end to partially pass into the end opening of a refrigeration system suction side valve fitting as it is depressing a valve stem of the valve fitting.

6. The refrigerant material transfer adapter of claim 5, wherein said opening means in said adapter body includes openings on opposite sides of said rectangular projection means in open fluid communication with said outlet end opening in the adapter.

7. The refrigerant material transfer adapter of claim 6, wherein said outlet end opening in the adapter includes a truncated cone portion with a slightly tapered wall that receives the threaded portion of an air conditioning system suction side valve fitting.

8. The refrigerant material transfer adapter of claim 7, wherein said outlet end opening in the adapter also includes an interior opening portion extending deeper into the adapter body from said truncated cone portion and within the mid body portion of the adapter to receive a nose portion of the air conditioning system suction side valve fitting.

9. The refrigerant material transfer adapter of claim 8, wherein said interior opening portion that receives a nose portion of the air conditioning system suction side valve fitting is also in the form of a truncated cone.

10. The refrigerant material transfer adapter of claim 8, wherein the back end of said adapter remote from said outlet end of said adapter is in the form of an end wall.

11. The refrigerant material transfer adapter of claim 10, wherein said side tube projection extends outward and backward relative to the outlet end at an angle from a plane normal to the longitudinal axis of the adapter.

12. The refrigerant material transfer adapter of claim 11, wherein said angle is approximately a forty five degree angle.

13. The refrigerant material transfer adapter of claim 11, wherein said side tube projection is at an angle and the adapter so sized and configured as to be contained within a protective cap placed on the valve stem end of said pressurized can with said adapter mounted on the valve stem of the pressurized can.

14. The refrigerant material transfer adapter of claim 3, wherein said side tube projection extends outward and backward relative to the outlet end at an angle from a plane normal to the longitudinal axis of the adapter.

15. The refrigerant material transfer adapter of claim 14, wherein said angle is approximately a forty five degree angle.

16. The refrigerant material transfer adapter of claim 14, wherein said side tube projection is at an angle and the adapter so sized and configured as to be contained within a protective cap placed on the valve stem end of said pressurized can with said adapter mounted on the valve stem of the pressurized can.

* * * * *

UNITED STATES PATENT AND TRADEMARK OFFICE

CERTIFICATE OF CORRECTION

PATENT NO. : 4,544,982

DATED : Oct. 1, 1985

INVENTOR(S) : David R. Boothman and John C. Forde

It is certified that error appears in the above-identified patent and that said Letters Patent are hereby corrected as shown below:

Page 1, after "Assignee:" delete "General Electric Company, Salem, Va." and substitute --Canadian General Electric Company, Limited, Toronto, Ontario, Canada--.

Signed and Sealed this

*Twenty-sixth* Day of *August 1986*

[SEAL]

*Attest:*

DONALD J. QUIGG

*Attesting Officer*

*Commissioner of Patents and Trademarks*